United States Patent [19]

Zepell

[11] Patent Number: 4,551,034

[45] Date of Patent: Nov. 5, 1985

[54] CLIP MOUNT INSERT

[75] Inventor: Nathan A. Zepell, Santa Barbara, Calif.

[73] Assignee: June R. G. Zepell, Santa Barbara, Calif.

[21] Appl. No.: 285,449

[22] Filed: Jul. 21, 1981

[51] Int. Cl.[4] ..... B43K 7/12; B43K 24/02; B43K 25/00

[52] U.S. Cl. ..... 401/104; 24/11 P; 401/29; 401/31

[58] Field of Search ..... 401/29, 31, 99, 104, 401/105, 106; 24/11 P, 11 F

[56] References Cited

U.S. PATENT DOCUMENTS

| | | | |
|---|---|---|---|
| 276,512 | 4/1883 | Webster | 24/11 P |
| 1,609,567 | 12/1926 | Mooney | 24/11 P |
| 1,719,895 | 7/1929 | Marshall | 24/11 P |
| 1,808,045 | 6/1931 | Krause | 24/11 P |
| 2,694,843 | 11/1954 | Marshall | 24/11 P |
| 3,233,593 | 2/1966 | Bowlby et al. | 401/31 |
| 3,912,401 | 10/1975 | Zepell | 401/31 |
| 4,185,933 | 1/1980 | Zepell | 401/104 |

FOREIGN PATENT DOCUMENTS

| | | | |
|---|---|---|---|
| 1561809 | 3/1970 | Fed. Rep. of Germany | 401/106 |
| 709260 | 1/1966 | Italy | 401/31 |
| 798155 | 7/1958 | United Kingdom | 401/104 |
| 1022608 | 3/1966 | United Kingdom | 401/31 |

*Primary Examiner*—Steven A. Bratlie
*Attorney, Agent, or Firm*—Harry W. Brelsford

[57] ABSTRACT

Various writing instrument parts are assembled to an insert that is inserted into a hollow body of the writing instrument to complete the assembly of parts. The insert has a glide stop and a spaced cartridge guide, and a compression spring pushes against the cartridge guide and a glide removably secured to the inner end of the cartridge. A clip is hinged to the insert by a snap-on socket fitting over a hinge bar. A biasing spring fits within a clip pocket and an insert pocket to prevent unseating the snap-on hinge. The clip pocket is formed by inwardly extending walls that telescope with the insert pocket to prevent twisting off the clip. The insert is held in the hollow body by a locking projection that fits within a hole in the wall of the hollow body member.

3 Claims, 6 Drawing Figures

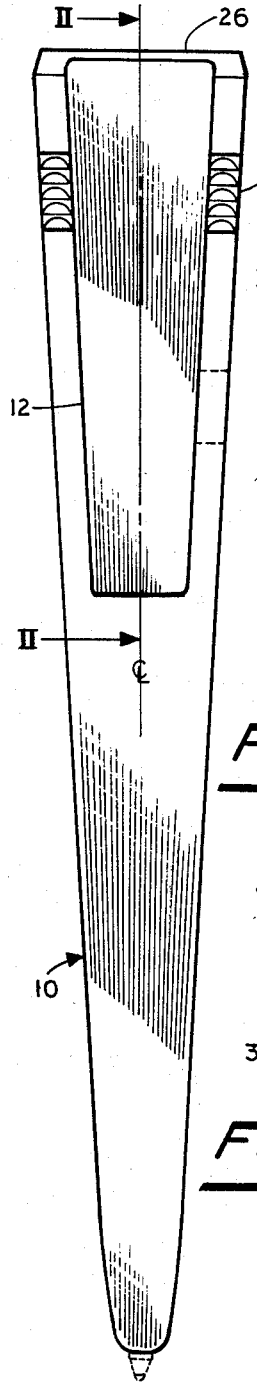
Fig. 1
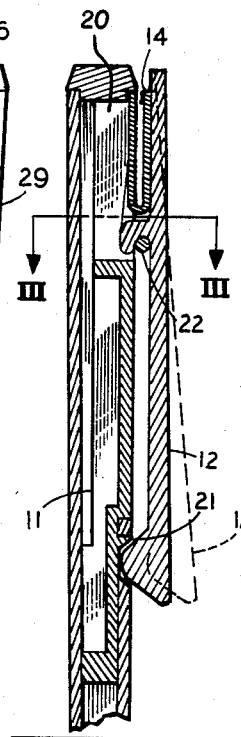
Fig. 2
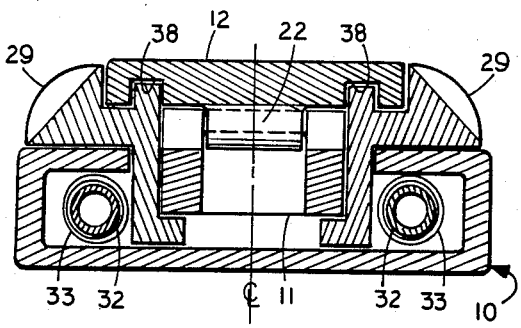
Fig. 3
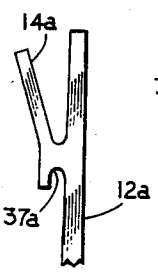
Fig. 6
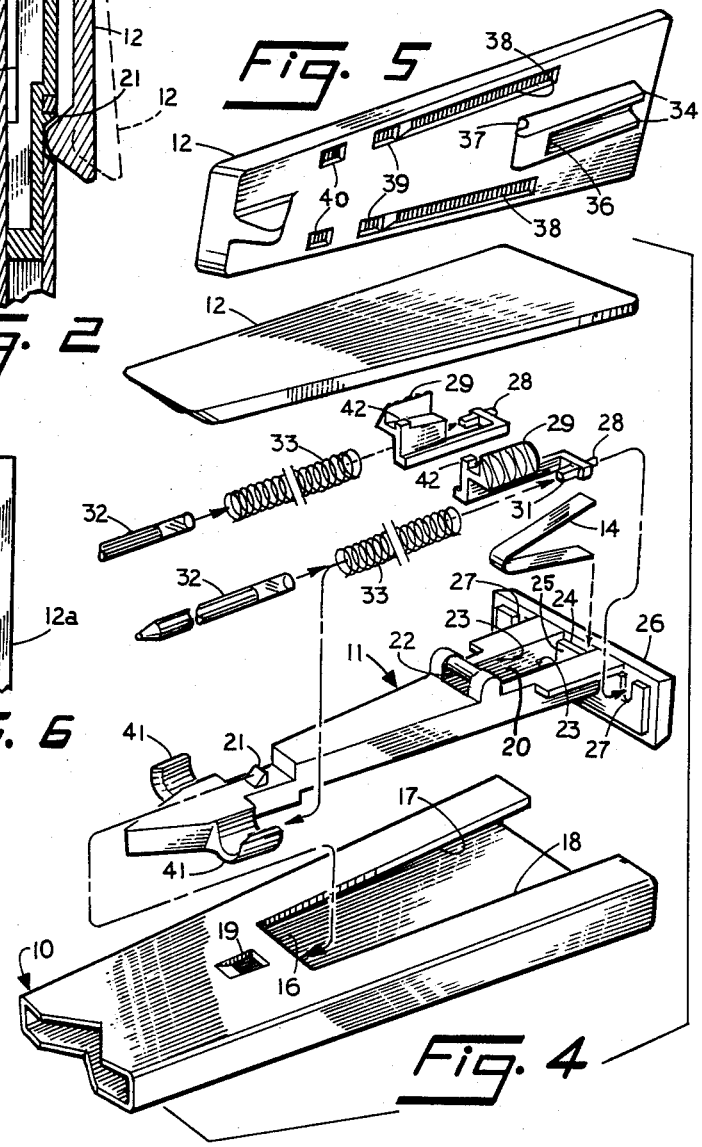
Fig. 5
Fig. 4

CLIP MOUNT INSERT

TECHNICAL FIELD

This invention relates to flat writing instruments wherein one of a plurality of different writing cartridges may be selected, each preferably having different colors, and has particular reference to an improved construction over that disclosed in my prior U.S. Pat. No. 4,185,933 issued Jan. 29, 1980.

BACKGROUND OF PRIOR ART

Writing instruments embodying the design of my said U.S. Pat. No. 4,185,933 have been widely manufactured and sold by me and various licensees. The commercial success of this flat two-cartridge pen has stimulated price competition. This flat type of pen, as shown in the patent drawings, is now sold world-wide and, while it has not been imitated, it does have price competition from multicolor pens, which are sold in large quantities. To remain competitive I must reduce the cost of my pen, which is primarily based on labor for assembly and secondarily on the cost of the parts.

Referring to my U.S. Pat. No. 4,185,933, the writing instrument has two cartridges, preferably of different color, and these are projected from the tip of the pen body selectively. A tension (expansion) spring is used to retract a cartridge when it is desired to place the pen in a pocket or to change colors. This tension spring must be manually attached to each side or glide to effect this retraction. This is a substantial element of labor cost.

Also, the spring for biasing the clip of the pen had to be glued on one end to a stationary part of the pen and the other end ultrasonically staked to the back side of the clip.

Furthermore, the body of the pen of U.S. Pat. No. 4,185,933 was formed in two longitudinal halves, and these two pieces had to be welded together. Ultrasonic welding was employed, requiring an additional labor step as well as capital expenditure for the equipment.

BRIEF SUMMARY OF THE INVENTION

I have redesigned the pen of my U.S. Pat. No. 4,185,933 to eliminate the foregoing labor expenditures. I have replaced the tension (expansion) spring with two compression springs that fit one over each of the cartridges. This is a quick and simple assembly operation requiring no mechanical time-consuming attachment of the spring to the cartridge glides.

I have redesigned the clip spring to use a U-shaped plate spring that fits into a pocket in the clip and a corresponding pocket in a stationary insert. I have designed the sidewalls of the spring pocket so that they serve not only as reinforcing ribs, but these in turn fit with the insert pocket sidewalls to stabilize the clip against twisting on its hinge. The U-shaped spring is snapped into place with no manual gluing required.

I have redesigned the body of the pen to make it a hollow one-piece construction, thereby eliminating an assembly step and eliminating the ultrasonic welding operation and eliminating equipment of the former two-piece body.

I have also redesigned the hinge of the clip to make it a snap-on type, held against accidental displacement by its projecting pocket walls and by the snap-in U-shaped spring. This assembly of the clip to a stationary part is a quick and simple hand operation saving much assembly time.

BRIEF DESCRIPTION OF THE DRAWINGS

Various objects, advantages, and features of the invention will be apparent in the following description and claims, considered together with the drawings forming an integral part of this specification in which:

FIG. 1 is an elevation view of the writing instrument embodying the invention and showing in broken outline a projected writing tip at the bottom of FIG. 1.

FIG. 2 is a fragmentary cross section of view along the line II—II of FIG. 1.

FIG. 3 is a sectional view of an enlarged scale of the structure of the upper parts of the FIGS. 1 and 2 taken along the line III—III of FIG. 2.

FIG. 4 is an exploded view in three dimensions of the upper part of the pen body of FIGS. 1 and 2 and showing also the insert into that hollow body, which insert carries with it a pair of writing cartridges and a clip.

FIG. 5 is a sectional view of the underside of the clip, which is the topmost item in FIG. 4, and FIG. 6 is a modified clip.

Referring to FIGS. 1 and 2, the writing instrument has a body member 10 in which is disposed an insert 11. The insert carries on it a clip 12 hinged to a crossbar 22 forming part of the insert 11, and the clip 12 in FIG. 2 is urged in clockwise rotation about the pivot bar 22 by means of a U-shaped spring 14.

Referring now to FIG. 4, the upper part of the pen body 10 is illustrated, and there it will be noted that the pen body is of hollow tubular construction and has a cutout in the upper surface of the tube defined by a transverse surface 16 and two side surfaces 17 and 18 that are parallel to the tapered outer edges of the body member. Also formed in the upper surface of the pen body 10 is a hole 19, and after assembly of the insert 11 to the body 10 a projection or locking finger 21 of the insert 11 is disposed in the hole 19.

Referring still to FIG. 4, it will be noted that the insert 11 is generally elongated and has the transverse hinge bar 22, and to the right of the bar 22 is a spring pocket 20 having side walls 23 and a righthand end wall 25. Formed also on the righthand end of the insert 11 is a head or closure portion 26, which closes off the top end of the pen body 10, as shown in FIG. 1. This closure 26 is also shown in FIG. 4 at the righthand end of the pen body. This closure 26 may have a pair of recesses 27 to receive a projecting pin 28 on glides 29. The glides 29 each have a square projection 31, to which are frictionally secured tubular right ends of writing cartridges 32. Disposed over the righthand end of each writing cartridge 32 is a compression helical spring 33 provided particularly in accordance with my new design.

Referring now to FIG. 5, it will be noted that the bottom or inner surface of the clip 12 has inwardly projecting longitudinal walls 34 and a transverse wall 36, which define a pocket in the underside of the clip 12. The same structure also has a transverse hinge socket 37 formed thereon, which engages the transverse hinge bar 22 of FIG. 4. The spring 14, best illustrated in FIG. 4, fits within the insert pocket 23–25 and fits within the clip pocket 34–36.

Referring still to FIG. 5, it will be noted that there is a slot 38, adjacent each edge of the clip 12 and two recesses 39 and two recesses 40. These recesses 39 act to lock a writing cartridge 32 in the extended position shown in broken outline in FIG. 1 when lock fingers 42 of the glides 29 engage the recesses 39, and when extended further the lock fingers 42 lock into the recesses 40 to facilitate removal of the cartridge and insertion of the fresh cartridge. The action of these lock fingers 42 and the recesses 39 and 40 is detailed in my U.S. Pat. No. 4,185,933.

Referring now to FIG. 3, it will be noted that the glides 29 are guided on the cutout edges 17 and 18 previously identified in FIG. 4, as well as in the slots 38 in the clip 12, and are guided also by the insert 11. The transverse hinge bar 22 is shown in broken outline.

Referring now to FIG. 5, it will be noted that the spring pocket formed by the side walls 34 and end wall 36 is disposed on the side away from the opening of the hinge socket 37.

ASSEMBLY OF PARTS

The assembly of parts is best explained with respect to FIGS. 4 and 5. An assembly person manually grasps a cartridge 32, passes it through a spring 33, and jams the right end of the cartridge tube over the square projection 31 on glide 29. The square projection permits air to enter the cartridge 32 as the ink is consumed during writing. The assembler next completes this same assembly of cartridge, spring, and glide for the second cartridge and lays them on a pair of projecting semi-cylindrical cartridge guides 41 on the lefthand end of the insert 11 as shown in FIG. 4. The springs 33 are greater in free length than the distance from the insert head 26 to these guides 41, and the assembler at the same time manually slides the left ends of the springs 33 toward the right to compress them sufficiently so that the left ends of springs 33 bear against the guides 41 and the righthand end of the compression springs 33 bear against the glides 29. The glide pins 28 mate in the recesses 27 in the insert head 26 to hold these cartridges in alignment as well as to hold the glides in alignment.

The cartridges 32, springs 33, and glides 29 now having been assembled to the insert 11, this entire subassembly of parts is next slid into the righthand end of the hollow body 10 and is moved to the left with respect to the body 10 until the locking projection 21 elastically deflects the body member 10 in the region of hole 19, whereupon the insert 11 and its subassembly parts are locked securely to the body 10 without the necessity of any gluing or any ultrasonic welding or staking.

The assembly person next presses the clip against the insert 11, bending the clip in the region from the hinge socket 37 to the lower tip or ball as viewed in FIGS. 1 and 2. This permits the hinge socket 37 to fit over the hinge bar 22 and when these two elements are mated the sidewalls 34 projecting from the underside of the clip 12 telescope within the insert socket defined by the sidewalls 23 and end wall 25. The clip 12 is preferably made of plastic to accommodate this bending to effect the assembly of the clip to the insert. The U-shaped spring 14 is next slid between the clip 12 and insert 11, one leg fitting within the clip sidewalls 34 and the end of the other leg resting on a step 24 in the insert, best shown in FIG. 4. The assembled U-shaped clip 14 is shown in FIG. 2.

OPERATION

The operation of the glides 29 to project one or the other of the writing cartridges 32 from the bottom of the body 10 as shown in FIG. 1 is explained in detail in my patent 4,185,933 and will be just briefly mentioned here. The writing cartridges 32 are normally held within the body in a retracted position. If a person wishes to project one or the other of the cartridges 32, he pushes the corresponding glide 29 to the left as viewed in FIG. 4. The spring 33 for that particular cartridge is thereby compressed, and the cartridge 32 is held in an extended position, as shown in broken outline in FIG. 1, by the lock finger 42 on each glide 29 engaging the recess 39 on the bottom of the clip 12, shown in FIG. 5. When the person is finished writing and wishes to retract the cartridge, he merely grasps the upper end of the writing instrument between his fingers, causing the clip 12 to rotate counterclockwise as viewed in FIG. 2 or the user can manually lift the lower or ball end of the clip. This rotated position of clip 12 is shown in broken outline in FIG. 2. This lifts the clip sufficiently, so that the lock finger 42 on the particular glide 29 is no longer held in the recess 39 and the compression spring 33 pushes against the glide to retract the cartridge 32. For removal of a spent cartridge, or to otherwise remove a cartridge, the glide is pushed beyond the recess 39 to the recess 40 on the underside of the clip 12, shown in FIG. 5, by rocking the clip as explained in my U.S. Pat. No. 4,185,933, whereupon a sufficient part of a cartridge 32 projects outwardly from the bottom of the writing instrument body 10 so that it may be manually grasped and the frictional grip of the cartridge on the square nubbin 31 is overcome and the spent cartridge removed. A fresh cartridge is then inserted along the particular side where the glide is retained in recess 41, and the compression springs 33 will be held in place after removal of a cartridge 32 by their compression between the cartridge guides 41 of the insert and the glide 29. The new cartridge will slip easily through the compressed compression springs 33 to again be shoved over the square projection 31 on the glide to be securely held by friction.

Regarding the assembly convenience of my design, it will be appreciated that the cartridge guides 41 on the insert 11 could be apertured ears through which a cartridge 32 passes.

However, for speed and convenience in assembly I prefer the open saddles for the guides 41. This permits the assembler to have the compression springs also resting on these guides prior to compression so that with a stroke of the finger the compression spring may be contacted and its left end pushed to the right until it seats against the righthand edge of the cartridge guides 41.

If for any reason a hard blow is struck against the clip 12 of the instrument, it will not be dislodged from its hinge because of the fact that the righthand end of walls 34 press against the socket wall 25 of insert 11 below shoulder 24. Also, the U-shaped plate spring 14 presses against the end step 24 (FIG. 4) as well as against the pocket end 36 in the clip as shown in FIG. 5. This relationship of parts that prevents unhinging the clip is also shown in FIG. 2. If now the clip 12 is struck a sidewise blow on one end, it will not be twisted off its hinge bar 22, because the clip pocket sidewalls 34 fit within, or telescope within, the insert pocket sidewalls 23. The clip pocket 34–36 and the insert pocket 23–25 therefore serve the dual purpose of not only providing a spring pocket, but they also prevent twisting the clip.

The use of the snap-on clip hinge greatly speeds assembly of the device, and the use of the U-shaped spring 14 makes this sliding action possible. The lock finger 21 on the insert 11 eliminates the need for gluing or otherwise securing the insert in the tubular body 10. The forming of the body 10 as a single piece of tube also eliminates an assembly operation compared to the structure of my U.S. Pat. No. 4,185,933.

The compression springs 33 eliminate the need for connecting one end of the expansion spring to a glide as shown in my U.S. Pat. No. 4,185,933.

MODIFICATION

Illustrated in FIG. 6 is a modification of the clip and spring, wherein the spring is integrally formed with the clip. A clip 12*a* has a hinge socket 37*a* formed on its lower side and projecting from the socket is a spring leaf 14*a*. The combined structure may be formed of elastic organic plastic material. The righthand end of the leaf spring 14*a* may rest on the step 24 of FIG. 4, and the hinge socket 37*a* may engage the cross bar 22 of FIG. 4.

Various improvements and modifications will occur to those skilled in the art, and, accordingly, I do not limit myself the precise embodiments shown as these are illustrative only of my invention. All variations and modifications of the structure that fall within the true spirit and scope of my invention are included within the scope of the following claims.

I claim:

1. In a writing instrument having a hollow body and an extendable writing cartridge normally held within the body and having means for holding the writing cartridge selectively in an extended position, an insert assembly for said body, comprising:

(a) an elongated insert having an outer side and an integral transverse hinge bar on said outer side and having a pocket in said outer side;

(b) a clip having an inner side and an outer side and two ends and having a snap-on hinge socket on the inner side open toward one end to snap on over the hinge bar;

(c) a spring disposed in the insert pocket and engaging the insert and the clip to bias the clip about the hinge bar to a gripping position.

2. In a writing instrument having a hollow body and an extendable writing cartridge normally held within the body and having means for holding the writing cartridge selectively in an extended position, an insert assembly for said body, comprising:

(a) an elongated insert having an outer side and an integral transverse hinge bar on said outer side and having a pocket in the outer side of the insert and an end wall on said pocket on the pocket end away from the hinge bar;

(b) a clip having an inner side and an outer side and two ends and having a snap-on hinge socket on the inner side open toward one end to snap on over the hinge bar and having a pocket formed on the inner side of the clip on the other clip end away from the snap-on hinge socket, said clip pocket having an end wall on the pocket end toward the hinge socket;

(c) and resilient means engaging the insert and the clip to bias the clip about the hinge bar to a gripping position and having an end that engages the clip pocket end wall and having another end that engages the insert pocket end wall; said insert pocket being on the part of the insert away from the open end of the snap-on socket of the clip;

whereby the resilient means prevents the clip from accidentally being snapped off of the hinge bar.

3. A writing instrument as set forth in claim 2 wherein the resilient means is a U-shaped plate spring.

* * * * *